US007814968B2

(12) United States Patent
Bizon

(10) Patent No.: US 7,814,968 B2
(45) Date of Patent: Oct. 19, 2010

(54) GRAVITY DRAINAGE APPARATUS

(76) Inventor: Dustin Bizon, 73 Erin Ridge Dr., St. Albert, AB (CA) T8N2B8

( * ) Notice: Subject to any disclaimer, the term of this patent is extended or adjusted under 35 U.S.C. 154(b) by 0 days.

(21) Appl. No.: 12/198,168

(22) Filed: Aug. 26, 2008

(65) Prior Publication Data

US 2009/0188661 A1 Jul. 30, 2009

(51) Int. Cl.
*E03B 3/11* (2006.01)
*E21B 43/24* (2006.01)

(52) U.S. Cl. ..... 166/50; 166/57; 166/272.3; 166/272.5; 166/272.6; 166/272.7

(58) Field of Classification Search ..... 166/272.3, 166/272.5, 272.7, 272.6, 269, 50, 57, 373
See application file for complete search history.

(56) References Cited

U.S. PATENT DOCUMENTS

| | | | | |
|---|---|---|---|---|
| 5,511,616 | A * | 4/1996 | Bert | 166/272.7 |
| 6,039,121 | A | 3/2000 | Kisman | |
| 6,073,696 | A | 6/2000 | Ellis | |
| 2005/0072567 | A1 * | 4/2005 | Steele et al. | 166/272.3 |
| 2006/0175061 | A1 | 8/2006 | Chrichlow | |
| 2007/0175638 | A1 | 8/2007 | Chrichlow | |

FOREIGN PATENT DOCUMENTS

CA 2549782 10/2007

OTHER PUBLICATIONS

Deutsch, et al., "Guide to SAGD (Steam Assisted Gravity Drainage) . . . ", Guidebook Series vol. 3, 2005, pp. 1-9, published by Centre for Computational Geostatistics, Edmonton, AB, Canada.

* cited by examiner

*Primary Examiner*—David J Bagnell
*Assistant Examiner*—Yong-Suk Ro
(74) *Attorney, Agent, or Firm*—Anthony R. Lambert

(57) ABSTRACT

A hydrocarbon production apparatus comprises an injection well, perforated casing, hydrocarbon viscosity reducing fluid injection tubing, a first wellbore restrictor, and a production well. The injection well is bored above the production well within a hydrocarbon reservoir below a ground surface. The injection well comprises a heel end and a toe end. The perforated casing is positioned along a length of the injection well. The hydrocarbon viscosity reducing fluid injection tubing is disposed within the injection well and has a hydrocarbon viscosity reducing fluid injection end. The first wellbore restrictor is transversely disposed within the perforated casing to control hydrocarbon viscosity reducing fluid flow along the injection well, the first wellbore restrictor being spaced closer to the toe end of the injection well than the hydrocarbon viscosity reducing fluid injection end of the hydrocarbon viscosity reducing fluid injection tubing is to the toe end. The first wellbore restrictor is movable through the injection well under control from the ground surface. This apparatus allows the propagation of, for example, the steam chamber in a steam assisted gravity drainage operation to be precisely controllable and adjustable, in order to more efficiently produce hydrocarbons from the hydrocarbon reservoir.

21 Claims, 3 Drawing Sheets

GRAVITY DRAINAGE APPARATUS

TECHNICAL FIELD

Gravity drainage apparatus and methods, including steam assisted gravity drainage (SAGD) apparatus and methods, and corresponding gravity drainage well pairs.

BACKGROUND

In a SAGD processes, steam is injected into a formation along the entire length of an injection well. This often results in an unpredictable and unequal propagation of the steam chamber around the entire length of the injection well. For example, steam heat may propagate excessively at the toe and/or heel sections of the injection well, with little propagation at the middle regions. The steam chamber, in general, tends to propagate through regions of the formation where there is the least resistance to flow, and usually does not propagate consistently and uniformly around the injection well. As a result, there may be regions in the formation that are not adequately extracted from. Thus, there is room for improvement in the SAGD art.

SUMMARY

A hydrocarbon production apparatus comprises an injection well, perforated casing, hydrocarbon viscosity reducing fluid injection tubing, a first wellbore restrictor, and a production well. The injection well is bored above the production well within a hydrocarbon reservoir below a ground surface. The injection well comprises a heel end and a toe end. The perforated casing is positioned along a length of the injection well. The hydrocarbon viscosity reducing fluid injection tubing is disposed within the injection well and has a hydrocarbon viscosity reducing fluid injection end. The first wellbore restrictor is transversely disposed within the perforated casing to control hydrocarbon viscosity reducing fluid flow along the injection well, the first wellbore restrictor being spaced closer to the toe end of the injection well than the hydrocarbon viscosity reducing fluid injection end of the hydrocarbon viscosity reducing fluid injection tubing is to the toe end. The first wellbore restrictor is movable through the injection well under control from the ground surface.

A method of hydrocarbon production from a hydrocarbon reservoir through which is bored an injection well and a production well is also disclosed. Hydrocarbon viscosity reducing fluid is injected into the injection well. The flow of hydrocarbon viscosity reducing fluid along the injection well is controllably restricted using a first movable wellbore restrictor. Hydrocarbons are produced from the production well.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
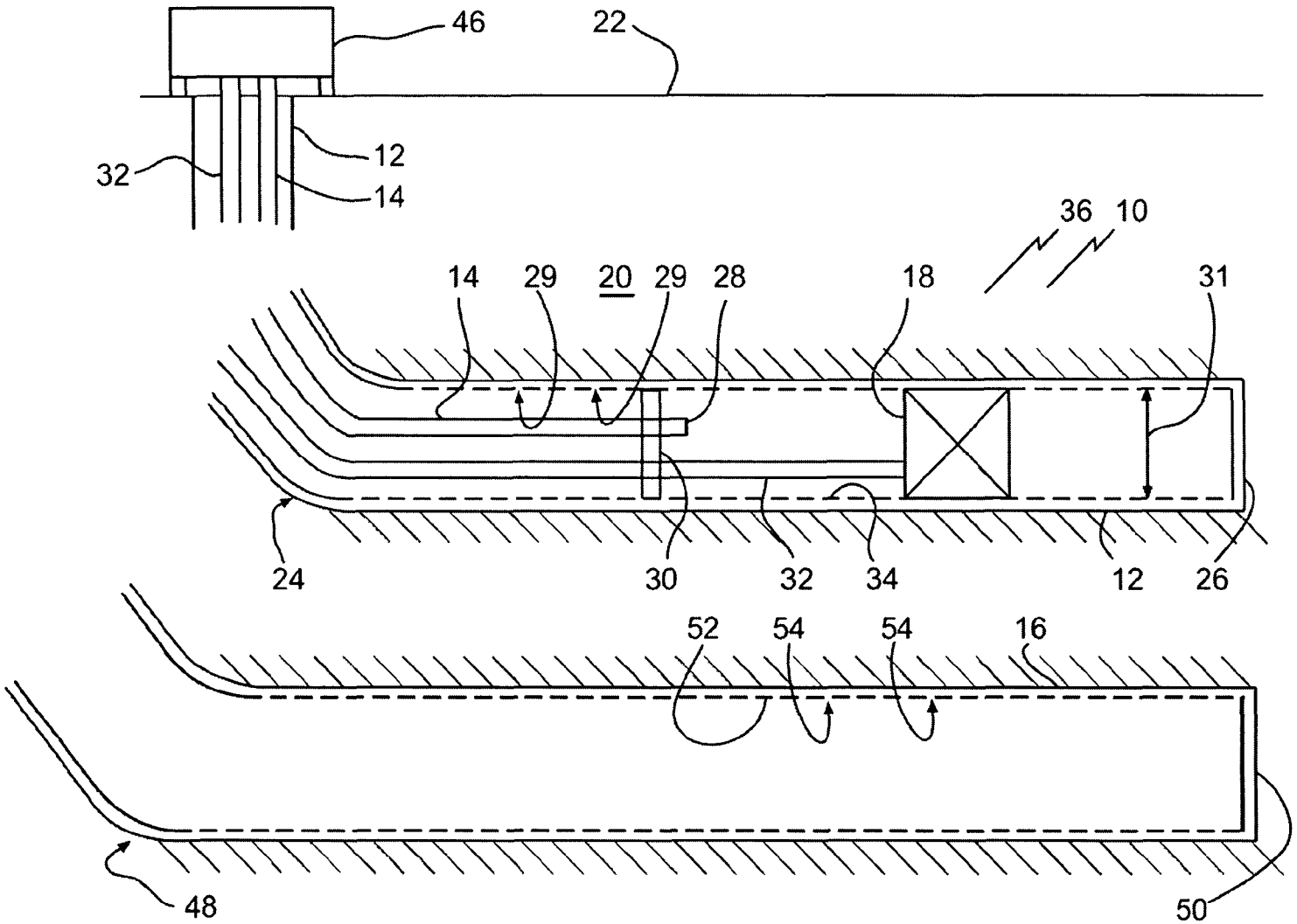
FIG. 1 is a side elevation view, partially in section and not to scale, of a hydrocarbon production apparatus lying within a hydrocarbon reservoir.

Steam-assisted gravity drainage (SAGD) is a hydrocarbon-producing process that is used to extract viscous hydrocarbons from hydrocarbon-producing reservoirs located under the ground surface. Conventional methods of hydrocarbon extraction, such as mining and/or drilling are generally ineffective or inefficient at extracting viscous hydrocarbons such as bitumen, crude oil, or heavy oil, and thus SAGD is used to add heat to the hydrocarbons to lower their viscosity to a point where they may be collected in a well for production. Examples of the type of hydrocarbon-producing reservoirs that contain these viscous hydrocarbons include oil sands located primarily in Canada and Venezuela.

Hydrocarbon viscosity reducing fluid assisted gravity drainage (HVRFAGD) is a hydrocarbon-producing process that includes SAGD and operates with analagous elements and characteristics. The SAGD embodiments described herein should be understood as being not limiting to the injection of steam, and may include the injection of hydrocarbon viscosity reducing fluids. HVRFAGD is a broader term than SAGD, in that any hydrocarbon viscosity reducing fluid is injected in HVRFAGD, in contrast with steam being injected in SAGD. Hydrocarbon viscosity reducing fluid includes, for example, any fluid that reduces the viscosity of hydrocarbons or oil based fluids. Hydrocarbon viscosity reducing fluids may or may not be hydrocarbon-based. Hydrocarbon viscosity reducing fluids include, for example, solvents, steam, gases, and chemicals contained therein. An example of a solvent includes any hydrocarbon solvent, paraffins, aromatics, aliphatics, alkanes, alkenes, alkynes, arenes, cyclics, gases, liquids, organic solvents, inorganic solvents, water, alcohols, protic/aprotics, phenyls, benzyls, halogens, ketones, aldehydes, esters, ethers, acids, bases, peroxides, amides, amines, imides, imines, and any nitrogen, phosphorous, carbon, hydrogen, and/or sulphur containing solvents. A hydrocarbon viscosity reducing fluid may require, for example, heating or cooling in order to function properly.

SAGD incorporates the use of well pairs to extract the viscous hydrocarbons. A well pair has an injection well and a production well. The injection and production may be horizontally drilled wells that extend distances of several kilometers from heel-to-toe. Steam is injected into the reservoir along the length of the injection well, permeating the formation and forming a steam chamber throughout the reservoir around the injection well. Viscous hydrocarbons contained within the steam chamber are heated and reduce in viscosity enough to drain by gravity into the production well, where they are pumped to the surface. This process allows viscous hydrocarbons contained within large, relatively horizontal reservoirs under the ground surface to be effectively extracted.

In a SAGD process incorporating well pairs, the injection well is placed above or close to above the production well, with a vertical separation distance from the production well of, for example, 1-80 m. In some embodiments, vertical separation distances of between 2-10 m are used. In an exemplary SAGD operation, multiple adjacent well pairs are used, in order to create a larger steam chamber from smaller overlapping and/or adjacent steam chambers. This way, a larger volume within a hydrocarbon-producing reservoir may be extracted from simultaneously, and more efficiently using the heat energy from steam injected from multiple wells. A steam chamber may extend, for example, 10 to 100 m above an injection well.

Referring to FIG. 1, a hydrocarbon production apparatus 10 is illustrated comprising an injection well 12, hydrocarbon viscosity reducing fluid injection tubing 14, a production well 16, a first wellbore restrictor 18, and perforated casing 34. Injection well 12 is bored above production well 16 within a hydrocarbon reservoir 20 below a ground surface 22. Hydrocarbon reservoir 20 may be any type of formation that contains hydrocarbons. In some embodiments, hydrocarbon reservoir 20 includes viscous hydrocarbons. Examples of such hydrocarbon reservoirs 20 include oil or tar sands. Injection well 12 comprises a heel end 24 and a toe end 26. In some embodiments, injection well 12 is a horizontal well. Perforated casing 34 is positioned along a length of injection well 12, around a bore diameter of injection well 12. Perforated casing 34 may have perforations 29 along at least a portion of a perforated casing length. Perforated casing 34 is intended to include, for example, any type of casing or coating around the bore diameter of injection well 12 that has provisions for injecting fluids from injection well 12 into reservoir 20. The perforated casing length is the length of the perforated casing, which may, for example, span heel end 24 to toe end 26. In some embodiments, perforated casing 34 has perforations 29 spaced along the entire perforated casing length. Perforations 29 may include slots or holes, for example. Injection well 12 may be any type of injection well known in the art. Hydrocarbon viscosity reducing fluid injection tubing 14 has a hydrocarbon viscosity reducing fluid injection end 28 and is disposed within injection well 12. Hydrocarbon viscosity reducing fluid injection tubing 14 may be steam injection tubing.

First wellbore restrictor 18 is transversely disposed within casing 34 to control hydrocarbon viscosity reducing fluid flow along injection well 12. In some embodiments, first wellbore restrictor 18 controls steam flow along injection well 12. In some embodiments, first wellbore restrictor 18 extends transversely fully across perforated casing. In such embodiments, first wellbore restrictor 18 extends fully across a perforated casing diameter 31. In addition, first wellbore restrictor 18 may be spaced closer to toe end 26 of injection well 12 than hydrocarbon viscosity reducing fluid injection end 28 of hydrocarbon viscosity reducing fluid injection tubing 14 is spaced to toe end 26 of injection well 12.

First wellbore restrictor 18 may be operable from ground surface 22 to move first wellbore restrictor 18 along injection well 12. In this way, first wellbore restrictor 18 is movable through injection well 12 under control from ground surface 22. First wellbore restrictor 18 may comprise a surface adjustable valve. In some embodiments, the surface adjustable valve is also operable from the ground surface 22. The surface adjustable valve may be, for example an iris or pinch valve. Valves of this sort may be obtained commercially and adapted for use with apparatus 10. An example of an iris valve includes the use of rotation plates defining an adjustable aperture. An example of a pinch valve includes a compressing body and sleeve. Fluid flow through first wellbore restrictor 18 may be adjustable to selectively adjust the flow through first and wellbore restrictor 18. Exemplary adjustments include adjusting the size of an aperture, changing the valve direction, or opening and closing the valve. Operable includes, for example, operating through electrical, electronic, or mechanical means.

In some embodiments, apparatus 10 may have coiled tubing 32 operatively connected between control equipment 46 at ground surface 22 and first wellbore restrictor 18, first wellbore restrictor 28 being movable through coiled tubing 32. An operator of control equipment 46 may thus operate control equipment 46 to change, for example, the position of first wellbore restrictor 28 or the size of the aperture of the valve (if any).

Hydrocarbon production apparatus 10 may also have a second wellbore restrictor 30 transversely disposed within perforated casing 34 to control hydrocarbon viscosity reducing fluid flow along injection well 12. In some embodiments, second wellbore restrictor 30 controls steam flow along injection well 12. In some embodiments, second wellbore restrictor 30 extends transversely fully across perforated casing 34. In such embodiments, second wellbore restrictor 30 extends transversely fully across perforated casing diameter 31. Second wellbore restrictor 30 may be spaced equidistant or closer to heel end 24 of injection well 12 than hydrocarbon viscosity reducing fluid injection end 28 of hydrocarbon viscosity reducing fluid injection tubing 14 is spaced to heel end 24 of injection well 12. In some embodiments, second wellbore restrictor 30 may be stationary. In other embodiments, second wellbore restrictor 30 is movable through injection well 12 under control from ground surface 22. Control from ground surface 22 may be carried out by, for example, control equipment 46. Control equipment 46 may comprise multiple or separate pieces of control equipment for the individual control of each of first and second wellbore restrictor 18 and 30, respectively. In some embodiments, second wellbore restrictor 30 may comprise a surface adjustable valve. The surface adjustable valve of second wellbore restrictor 30 may include all the characteristics and features described above for the surface adjustable valve of first wellbore restrictor 18.

Second wellbore restrictor 30 may be operable from ground surface 22, in a fashion similar to that described above for first wellbore restrictor 18. Where second wellbore restrictor 30 includes a surface adjustable valve, operating second wellbore restrictor 30 from ground surface 22 may include moving second wellbore restrictor 30 and/or adjusting the size of an aperture (if any) on second wellbore restrictor 30. In some embodiments, second wellbore restrictor 30 is operatively connected to hydrocarbon viscosity reducing fluid injection tubing 14. Second wellbore restrictor 30 may be operatively connected at or near hydrocarbon viscosity reducing fluid injection end 28 of hydrocarbon viscosity reducing fluid injection tubing 14, as illustrated in FIG. 1. In some embodiments, second wellbore restrictor 30 may be operatively connected to hydrocarbon viscosity reducing fluid injection tubing 14 at any point along hydrocarbon viscosity reducing fluid injection tubing 14. Hydrocarbon viscosity reducing fluid injection tubing 14 may also be movable through injection well 12 under control from ground surface 22. In this way, when hydrocarbon viscosity reducing fluid injection tubing 14 is repositioned, second wellbore restrictor 30 is correspondingly indirectly repositioned. If second wellbore restrictor 30 has a surface adjustable valve, the surface adjustable valve may be operated from ground surface 22 through hydrocarbon viscosity reducing fluid injection tubing 14, or through a secondary control mechanism, for example coiled tubing.

In some embodiments, either or both first or second wellbore restrictors 18 and 30, respectively, may be a valve, a flow restrictor, or a flow preventer. Where either or both first or second wellbore restrictors 18 and 30, respectively are flow restrictors, the flow restrictor may include a plate with at least one aperture for fluid to flow through. Where either or both first or second wellbore restrictors 18 and 30, respectively, are flow preventers, the flow preventer may include, for example, a plate spanning perforated casing diameter 31. Fluid flow through either or both of first and second wellbore restrictors 18 and 30, respectively, may be controllable from ground surface 22. This may be accomplished by selectively making flow through adjustments to either or both first and second wellbore restrictors 18 and 30, respectively. Exemplary adjustments include adjusting the size of a flow-through opening, changing the valve direction, or opening and closing the valve.

Referring to FIG. 1, production well 16 may have a heel end 48 and a toe end 50. Production well 16 may also comprise production perforated casing 52 having perforations 54 along at least a portion of a production perforated casing length. The production perforated casing length is the length of production perforated casing 52, which may, for example, span heel end 48 to toe end 50. In some embodiments, production perforated casing 52 has perforations 54 spaced along the entire perforated casing length. Perforations 54 may include slots or holes, for example. In some embodiments, production well 16 may be any type of production well known in the art.

Figure 4:
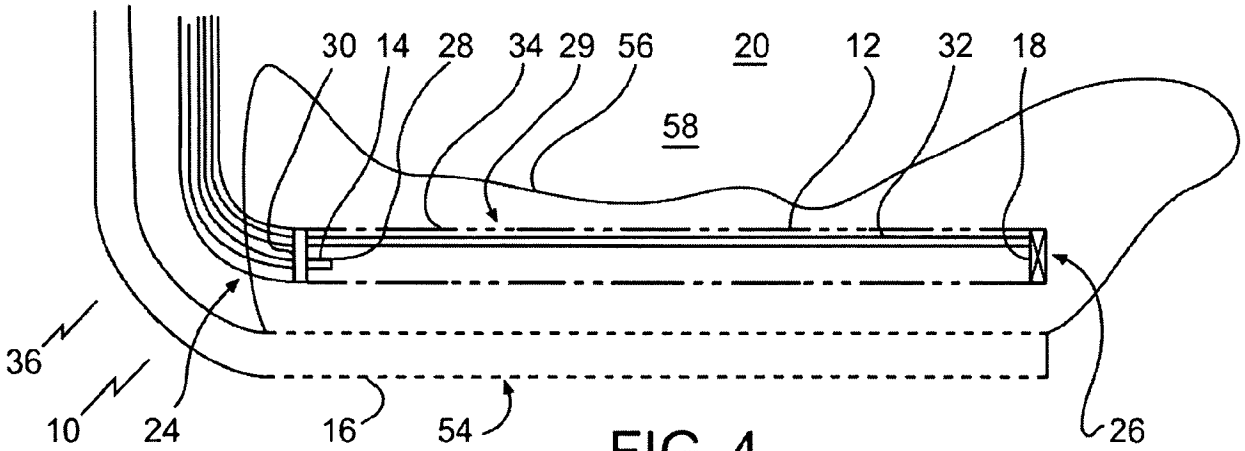
FIGS. 4-5 show side elevation views, partially in section and not to scale, of the hydrocarbon production apparatus being used in a steam-assisted gravity drainage operation.
Figure 5:
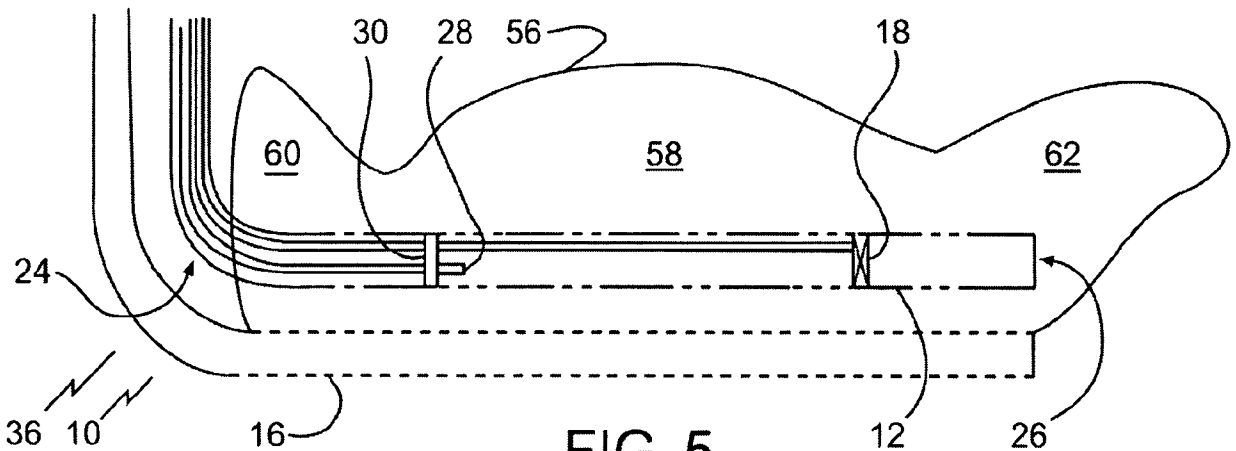

Referring to FIGS. 1, 4, and 5, hydrocarbon production apparatus 10 may be used in a steam-assisted gravity drainage (SAGD) operation. Injection well 12 and production well 16 together define a SAGD well pair 36. SAGD may be used to remove viscous hydrocarbons, such as heavy oil, crude oil, and/or bitumen, from a hydrocarbon reservoir. Multiple SAGD well pairs 36 may be used in a SAGD operation. Hydrocarbons in this document may comprise oil.

Injection well 12 and production well 16 may be drilled by conventional methods. Injection well 12 and production well 16 may be drilled from different or adjacent locations. When drilled from different locations, injection well 12 and production well 16 may be aligned using known methods. Injection well 12 and production well 16 may extend, for example, anywhere from several meters to several kilometers in length from heel to toe. Injection well 12 may be situated, for example, 1-10 meters or more above production well 16. Various methods may be used to accurately align injection well 12 with production well 16, including for example, active magnetic ranging or rotary magnet systems. It should be understood that the word "above" does not require absolute vertical alignment, and in general it is a very difficult practice to vertically line up injection well 12 with production well 16. In some embodiments, in which multiple injection wells 12 and production wells 16 may be used, injection wells 12 may be vertically offset from production wells 16. In addition, in a SAGD operation, a pad of, for example, 2-100 well pairs 36 may be used to extract from a larger volume of reservoir 20.

Figure 2:
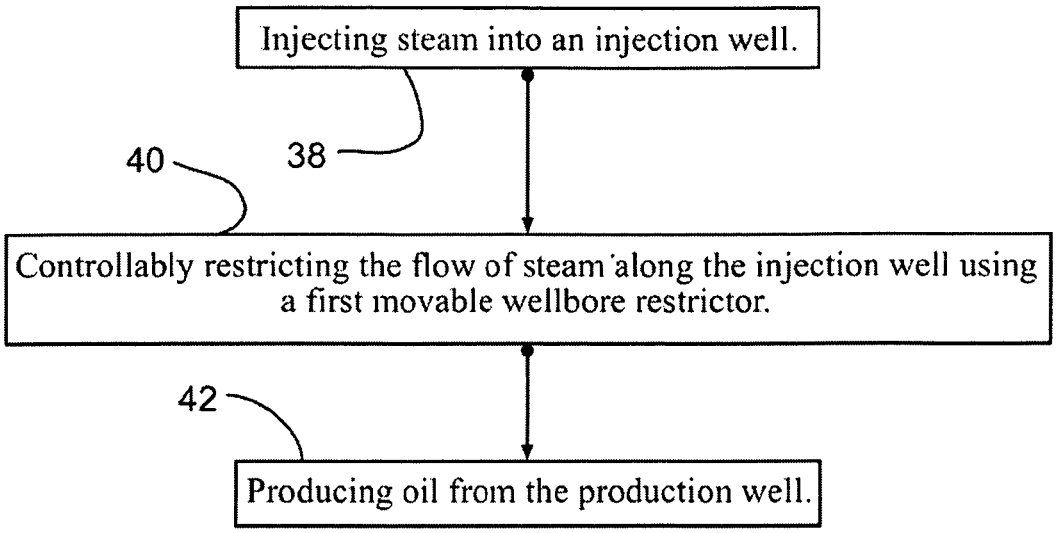
FIG. 2 is a flow chart illustrating a method of hydrocarbon production with a first wellbore restrictor.

Referring to FIG. 2, a method of hydrocarbon production is illustrated. Referring to FIGS. 4 and 5, the method of hydrocarbon production will be described for a SAGD process, with any elements containing the phrase "hydrocarbon viscosity reducing fluid" being renamed to include the word "steam" in place of "hydrocarbon viscosity reducing fluid". It should be understood that the example shown in the figures may be adapted to use any hydrocarbon viscosity reducing fluid in place of steam. Referring to FIG. 4, first wellbore restrictor 18, steam injection tubing 14, and second wellbore restrictor 30 (if present) are placed within perforated casing 34 between heel end 24 and toe end 26. In step 38 (shown in FIG. 2), steam is injected into injection well 12. Steamy may be injected from steam injection end 28 of steam injection tubing 14 disposed within injection well 12. Injecting steam into injection well 12 may comprise injecting steam into hydrocarbon reservoir 20 through perforated casing 34 along a length of injection well 12. In some embodiments, steam may be initially injected from production well 16 and injection well 12, in order to assist in the formation of a steam chamber 56 that connects between production well 16 and injection well 12. Steam may be injected through the use of a pump or a pumping system, in order to ensure that steam entering injection well 12 is of high enough pressure to penetrate reservoir 20. Steam enters injection well 12 through steam injection end 28, and is then injected through perforations 29 into reservoir 20 along the length of perforated casing 34 between second wellbore restrictor 30 and first wellbore restrictor 18. The injection of steam into reservoir 20 creates steam chamber 56. In some embodiments, injecting steam into injection well 12 further comprises injecting steam into injection well 12 between first movable wellbore 18 restrictor and second movable wellbore restrictor 30.

In step 40, the flow of steam along injection well 12 is controllably restricted using first movable wellbore restrictor 18. Controllably restricted may include, for example restricting the flow of steam across, allowing steam to flow freely across, or blocking the flow of steam across, first movable wellbore restrictor 18.

Referring to FIG. 1, control equipment 46 located on ground surface 22 may be used to operate and/or move first movable wellbore restrictor 18. At any point during operation of apparatus 10, first wellbore restrictor 18 may be moved through injection well 12. Control equipment 46 operates coiled tubing 32 which in turn operates first wellbore restrictor 18. Referring to FIG. 4, in some embodiments, first wellbore restrictor 18 is moved through injection well 12 to a first position at or near toe end 26 prior to step 38. In other embodiments, the first position may be located anywhere along the perforated casing length of injection well 12, and does not have to be at or near toe end 26. First wellbore restrictor 18 is moved using coiled tubing 32 to direct first wellbore restrictor 18 into position. Coiled tubing 32 may include a control rod (not shown). Coiled tubing 32 may be inserted, for example, through a packing gland (not shown) at the wellhead. If second wellbore restrictor 30 is present, second wellbore restrictor 30 may have, for example a sealed opening through which coiled tubing 32 may pass through.

Figure 3:
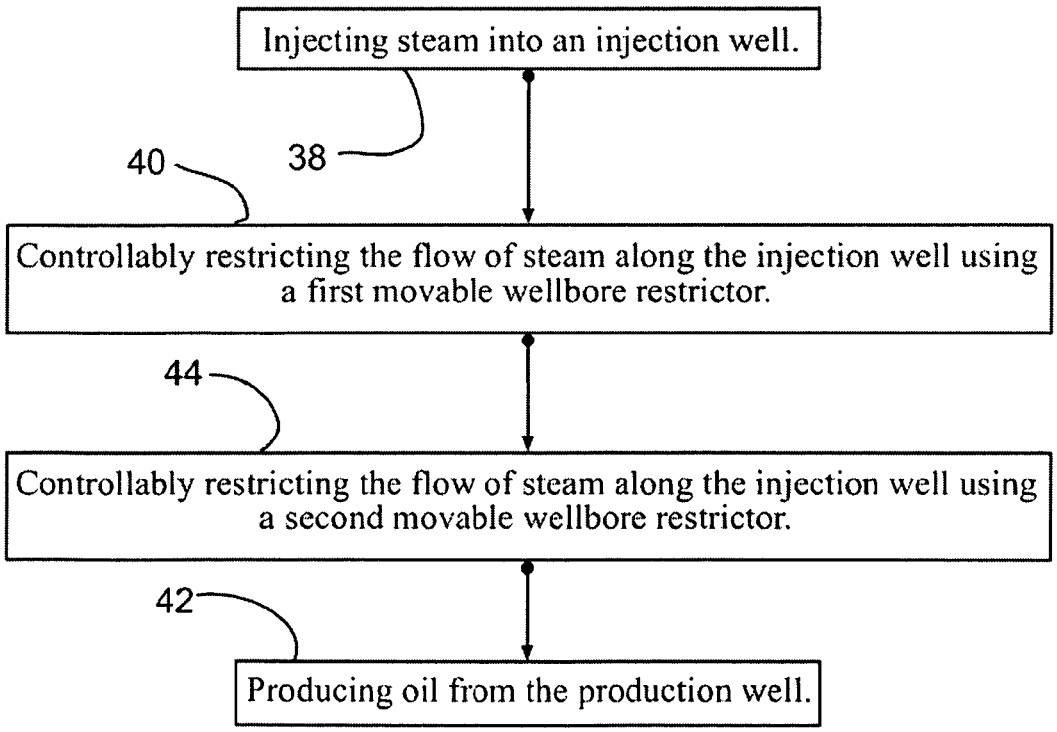
FIG. 3 is a flow chart illustrating a method of hydrocarbon production with first and second wellbore restrictors.

Referring to FIG. 3, some embodiments of the method include a step 44 of controllably restricting the flow of steam along injection well 12 using second movable wellbore restrictor 30. Similar to first wellbore restrictor 18, controllably restricted may include, for example restricting the flow of steam across, allowing steam to flow freely across, or blocking the flow of steam across, second movable wellbore restrictor 30. Steps 44 and 42 may occur at any point and in any relative order possible in the methods illustrated herein.

Referring to FIG. 1, control equipment 46 located on ground surface 22 may be used to operate and/or move second movable wellbore restrictor 30. At any point during operation of apparatus 10, second wellbore restrictor 18 may be moved through injection well 12. Second wellbore restrictor 18 may be moved, for example, indirectly using steam injection tubing 14. In these embodiments, steam injection end 28 is moved to a second position which is closer to heel end 24 of injection well 12 than first wellbore restrictor 18. In some embodiments, the second position is at or near heel end 24 of injection well 12. In other embodiments, the second position may be located anywhere along the perforated casing length of injection well 12. Referring to FIG. 1, the position of steam injection end 28 may be controlled using control equipment 46 located on ground surface 22. Control equipment 46 operates steam injection tubing 28 which in turn operates steam injection end 28.

Referring to FIG. 4, in the embodiment shown, second wellbore restrictor 30 is attached to steam injection tubing 14. Thus, operating control equipment 46 (shown in FIG. 1) to move steam injection tubing 28 also moves second wellbore restrictor 30. Control equipment 46 (shown in FIG. 1) may also be used to operate second wellbore restrictor 30, for example to change the flow characteristics of second wellbore restrictor 30. This control may be enacted through steam injection tubing 14 or additional control mechanisms. An example of an additional control mechanism includes additional coiled tubing (not shown). In some embodiments, different control equipment may be used to individually control each of first wellbore restrictor 18, second wellbore restrictor 30, and steam injection tubing 14.

At any point after the injection of steam into reservoir 20 has begun, and upon the creation of steam chamber 56, hydrocarbons may be collected within production well 16, as illustrated in step 42 of both the methods shown in FIGS. 2 and 3. Referring to FIG. 4, prior to collecting hydrocarbons within production well 16, steam injection through production well 16, if any, is shut off. The injected steam heats the hydrocarbons, reducing its viscosity and allowing it to drain by gravity, through perforations 54 of production well 16, where it may be transported to ground surface 22 (shown in FIG. 1). A pump or a pumping system may be involved for this step. The produced hydrocarbons may include water condensed from the injection of steam, and may require processing steps to separate the water and purify the hydrocarbons.

In the example shown in FIG. 4, first wellbore restrictor 18 and second wellbore restrictor 30 are positioned at toe and heel ends 26 and 24, respectively. Accordingly, steam is injected along almost the entire length of injection well 12, similarly to the injection of steam in a regular SAGD process where neither first nor second wellbore restrictors 18 and 30, respectively, are present. As previously discussed, this type of injection into reservoir 20 may create steam chamber 56 with a non-uniform propagation. For example purposes only, in the illustration of FIG. 4 steam chamber 56 has not propagated into region 58, region 58 being roughly positioned above an intermediary position between heel and toe ends 24 and 26, respectively. It should be understood that the steam chamber is a three dimensional zone that extends from injection well 12.

The propagation of steam chamber 56 may be determined by conventional methods, for example thermal graphing technology or sensor systems. An example of a sensor system may include thermocouples. Conventional well logging equipment may be employed within injection well 12, production well 16, or any additional well (not shown), in order to map out steam chamber 56. These methods aid an operator of apparatus 10 in adjusting the position and orientations of first and second wellbore restrictors 18 and 30, respectively, to compensate for non-ideal propagation of steam chamber 56. Referring to the example shown in FIG. 4, an operator would then adjust the positions of first and second wellbore restrictors 18 and 30, respectively to force steam chamber 56 into region 58. Referring to FIG. 5, first wellbore restrictor 18 has been repositioned to a new first position. In this illustration, the new first position is closer to heel end 24 than the previous first position. Similarly second wellbore restrictor 30 has been repositioned to a new second position. In this illustration, the new first position is closer to toe end 26 than the previous second position. Once repositioned, steam may be re-injected through steam injection end 28, forcing steam chamber 56 into region 58, as illustrated. Hydrocarbons contained within region 58 is now free to drain into production well 16.

If either or both of first or second wellbore restrictors 18 and 30, respectively contain or are surface adjustable valves, the valves may be adjusted at any point during the operation of apparatus 10. Referring to FIG. 5, for example, an operator may determine that, in order to ensure that regions 60 and 62 of steam chamber 56 still have sufficient steam propagation to maintain steam chamber 56, first and second wellbore restrictors 18 and 30, respectively, may be opened to a degree such that some steam is allowed to travel through first and second wellbore restrictors 18 and 30, where it may be injected into reservoir 20 along injection well 12 at positions closer to heel and toe ends 24 and 26, respectively. The degree of opening of the valves may be determined by the extent of propagation of steam chamber 56 in regions 60 and 62, for example. In some embodiments, either or both valves of first or second wellbore restrictors 18 and 30, respectively, may be closed entirely.

The embodiment of the method of hydrocarbon production described above is for example purposes only, and is not intended to limit in any way the scope of the claims. In some embodiments of the methods of FIGS. 2 and 3, first and/or second wellbore restrictors 18 and 30, respectively, may be placed at intermediate locations within injection well 12, between heel and toe ends 24 and 26 prior to the injection of steam. In a further embodiment, a method of hydrocarbon production is carried out by initially moving second wellbore restrictor 30 at heel end 24, and further by moving first wellbore restrictor 18 a distance along injection well 12 towards toe end 26. A distance may include, for example, 200 m. Steam is then injected, and steam chamber 56 developed. Second wellbore restrictor 18 and first wellbore restrictor 30 may then be moved corresponding increments of distance towards toe end 26, for example 150 m. Upon first and second wellbore restrictors 18 and 30 reaching their new positions, steam may be injected once again. The process may be repeated along the entire perforated casing length. At any point during operation, any valves present as part of first and second wellbore restrictors 18 or 30 may be manipulated. In addition, in some embodiments steam may be injected whilst first and/or second wellbore restrictors 18 and 30 are in motion. The distance between first and second wellbore restrictors 18 and 30 is adjustable and can include, for example, a range of separations from several meters to the entire length of perforated casing 34. In some embodiments of any method described herein, production well 16 may be periodically throttled to ensure that no steam is produced from production well 16.

Further embodiments of FIG. 2 may be carried out with no second wellbore restrictor 30 present. Such a method may, for example, involve initially moving first wellbore restrictor 18 to a position several hundred meters from heel end 24. Steam is then injected from steam injection end 28 at a position closer to heel end 24 than first wellbore restrictor 18. Thermal graphing data is then analyzed, and first wellbore restrictor 18 moved a corresponding distance closer to toe end 26. Steam is then re-injected. The process may be repeated until a uniform steam chamber 56 is developed. In some embodiments of the method of FIG. 2, first wellbore restrictor 18 is positioned closer to heel end 24 than steam injection end 28.

Using the embodiments described herein, the steam chamber formed from the injected steam into the hydrocarbon producing reservoir 20 can be continually adjusted and optimized in order to maximize hydrocarbon recovery, and increase the life of the well.

The methods and apparatuses disclosed herein have several advantages over previous SAGD methods and apparatuses. Firstly, they afford the formation of a steam chamber that more uniformly covers the regions adjacent to the injection well. This way, a hydrocarbon-producing reservoir may be efficiently and predictably extracted from, for maximum recovery of the hydrocarbons contained within. Secondly, because a more effective and uniform steam chamber is formed, less overall steam is required to operate apparatus 10. This is due to the careful and precise adjustments of first and/or second wellbore restrictors 18 and 30 in order to aim the injection of steam into non-propagating regions, which may be contrasted with conventional methods of simply blasting the formation with endless streams of steam to achieve a uniform steam chamber.

Apparatus 10 may be formed by adapting existing SAGD well pairs, simply by incorporating any of the additional required parts, for example first and second wellbore restrictors 18 and 30, and steam injection tubing 14. Furthermore, apparatus 10 may be used with other hydrocarbon extraction processes, for example vapor extraction (VAPEX), in situ combustion (ISC), or toe heel air injection (THAI). VAPEX uses solvents instead of steam to displace hydrocarbons and reduce the hydrocarbons viscosity. ISC uses oxygen to generate heat that reduces the viscosity of the hydrocarbons, simultaneously producing carbon dioxide generated by heavy crude oil to displace hydrocarbons down toward the production well. Apparatus 10 is intended to be adaptable to any type of injection well pair, and thus it should be understood that other injection fluids may be used in place of steam, for example any hydrocarbon viscosity reducing fluid. It is not required for injection well 12 to have toe end 26, for example in the case of a U-tube style injection well that has two portals at ground surface 22.

Any water used in the methods described herein may be recycled at ground surface 22, and subsequently re-used in the injection of steam.

Immaterial modifications may be made to the embodiments described here without departing from what is covered by the claims.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

What is claimed is:

1. A hydrocarbon production apparatus comprising:

an injection well bored above a production well within a hydrocarbon reservoir below a ground surface, the injection well comprising a horizontal section with a heel end and a toe end, the injection well and production well forming a well pair;

perforated casing along a length of the horizontal section;

hydrocarbon viscosity reducing fluid injection tubing disposed within the horizontal section and having a hydrocarbon viscosity reducing fluid injection end;

a first wellbore restrictor transversely disposed within the perforated casing to control hydrocarbon viscosity reducing fluid flow along the injection well;

the first wellbore restrictor being spaced closer to the toe end than the hydrocarbon viscosity reducing fluid injection end of the hydrocarbon viscosity reducing fluid injection tubing is to the toe end;

a second wellbore restrictor transversely disposed within the perforated casing to control hydrocarbon viscosity reducing fluid flow along the injection well;

the second wellbore restrictor being spaced equidistant or closer to the heel end than the hydrocarbon viscosity reducing fluid injection end of the hydrocarbon viscosity reducing fluid injection tubing is to the heel end of the horizontal section; and the first wellbore restrictor and the second wellbore restrictor each being movable through the horizontal section of the injection well under control from the ground surface to target injection into the hydrocarbon reservoir to produce a uniform hydrocarbon viscosity reducing fluid chamber above the horizontal section during use.

2. The apparatus of claim 1 in which the first wellbore restrictor extends transversely fully across the perforated casing.

3. The apparatus of claim 1 in which the second wellbore restrictor extends transversely fully across the perforated casing.

4. The apparatus of claim 1 in which the second wellbore restrictor comprises a surface adjustable valve.

5. The apparatus of claim 1 in which the second wellbore restrictor is operatively connected to the hydrocarbon viscosity reducing fluid injection tubing.

6. The apparatus of claim 1 in which the first wellbore restrictor comprises a surface adjustable valve.

7. The apparatus of claim 1, further comprising coiled tubing operatively connected between control equipment at the ground surface and the first wellbore restrictor.

8. The apparatus of claim 1 in which the hydrocarbon viscosity reducing fluid injection tubing is movable through the injection well under control from the ground surface.

9. The apparatus of claim 1 in which the production well comprises perforated production casing.

10. The apparatus of claim 1 in which the hydrocarbon viscosity reducing fluid is steam.

11. The apparatus of claim 10 used in a steam-assisted gravity drainage operation.

12. A method of hydrocarbon production from a hydrocarbon reservoir through which is bored an injection well above a production well to form a well pair, the injection well comprising a horizontal section with a toe end and a heel end, the method comprising the steps of:

injecting hydrocarbon viscosity reducing fluid into the injection well from a hydrocarbon viscosity reducing fluid injection end of hydrocarbon viscosity reducing fluid injection tubing disposed within the injection well between a first movable wellbore restrictor and a second movable wellbore restrictor, the first movable wellbore restrictor and second movable wellbore restrictor disposed at a first position and a second position, respectively, within the horizontal section, the first movable wellbore restrictor spaced closer to the toe end than the hydrocarbon viscosity reducing fluid injection end is to the toe end;

controllably restricting the flow of hydrocarbon viscosity reducing fluid along the injection well using the first movable wellbore restrictor and the second movable wellbore restrictor;

moving at least one of the first wellbore restrictor and the second wellbore restrictor into a new first position or new second position, respectively, in the horizontal section, the positioning of the first wellbore restrictor and second wellbore restrictor selected to target injection into areas of relatively low propagation of hydrocarbon viscosity reducing fluid in the hydrocarbon reservoir above the injection well;

injecting hydrocarbon viscosity reducing fluid into the injection well from the hydrocarbon viscosity reducing fluid injection end;

controllably restricting the flow of hydrocarbon viscosity reducing fluid along the injection well using the first movable wellbore restrictor and the second movable wellbore restrictor; and producing hydrocarbons from the production well.

13. The method of claim 12, in which injecting hydrocarbon viscosity reducing fluid into the injection well comprises injecting hydrocarbon viscosity reducing fluid into the hydrocarbon reservoir through perforated casing along a length of the horizontal section.

14. The method of claim 12, in which at least one of the new first position and the new second position are determined using thermal graphing technology.

15. The method of claim 12 in which the second movable wellbore restrictor is operatively connected to the hydrocarbon viscosity reducing fluid injection tubing.

16. The method of claim 12, further comprising adjusting the flow through the second movable wellbore restrictor using control equipment at the ground surface.

17. The method of claim 12, further comprising adjusting the flow through the first movable wellbore restrictor using control equipment at the ground surface.

18. The method of claim 12, in which controllably restricting the first movable wellbore restrictor further comprises controllably restricting the first movable wellbore restrictor using coiled tubing controlled by control equipment at the ground surface.

19. The method of claim 12, in which the hydrocarbon viscosity reducing fluid used is steam.

20. The method of claim 19 used as a steam-assisted gravity drainage operation.

21. The method of claim 12 in which moving comprises moving such that the first wellbore restrictor and second wellbore restrictor are positioned closer together.

* * * * *